US005768932A

United States Patent [19]

Hahn

[11] Patent Number: 5,768,932

[45] Date of Patent: Jun. 23, 1998

[54] DOUBLE ACTION HYDRAULIC CONTAINER DOMER

[76] Inventor: Roger A. Hahn, 16576 W. 51st Pl., Golden, Colo. 80403

[21] Appl. No.: 694,598

[22] Filed: Aug. 9, 1996

[51] Int. Cl.[6] ..... B21D 51/26

[52] U.S. Cl. ..... 72/348; 72/453.13

[58] Field of Search ..... 72/347, 348, 349, 72/350, 351, 453.05, 453.13

[56] References Cited

U.S. PATENT DOCUMENTS

| | | | |
|---|---|---|---|
| 1,967,245 | 7/1934 | Hothersall | 72/351 |
| 2,075,847 | 4/1937 | Hothersall . | |
| 2,591,061 | 4/1952 | Gaudreau | 72/351 |
| 4,289,014 | 9/1981 | Maeder et al. . | |
| 4,589,270 | 5/1986 | Lee, Jr. et al. . | |
| 4,620,434 | 11/1986 | Pulciano et al. . | |
| 4,930,330 | 6/1990 | Weishalla . | |
| 5,016,463 | 5/1991 | Johansson et al. | 72/348 |

*Primary Examiner*—Lowell A. Larson
*Attorney, Agent, or Firm*—Timothy J. Martin; Michael R. Henson

[57] ABSTRACT

A forming apparatus uses counteracting, hydraulically coupled pistons to form a dome structure in the bottom panel of the container, such as a beverage can. A pressure ring is on one piston, and a doming die is on the other piston. The pistons are received in a piston housing that also provides a primary fluid reservoir so that, when one piston moves in one direction to displace fluid, the displaced fluid moves the other piston in the opposite direction. The pistons are coaxial and one is received in the other. Return springs are provided to bias the pistons into a desired orientation. A secondary reservoir may be provided to receive overflow fluid. Here, a first one-way valve sets a threshold so that fluid will flow into the secondary reservoir when the pressure in the primary reservoir exceeds the threshold. A second one-way valve permits fluid to return to the primary reservoir when the return springs move the pistons to a starting orientation. The secondary reservoir also permits the pistons to have a limit stop for countermovement at which point they undergo common movement with fluid being overflowed into the secondary reservoir.

26 Claims, 5 Drawing Sheets

DOUBLE ACTION HYDRAULIC CONTAINER DOMER

FIELD OF THE INVENTION

The present invention broadly relates to the manufacturer of containers, especially drawn and iron steel or aluminum containers such as used in the food and beverage industry. More particularly, the present invention concerns the formation of a bottom profile of a container to provide mechanical strength when it is filled and pressurized.

BACKGROUND OF THE INVENTION

The need for packaging of food and beverage products for storage and sale has increased as populations have risen and urbanization intensified. In addition, the demand for convenient, ready-to-eat products have added to the demand for suitable packaging. A long standing technique for packaging certain foods and beverages is the familiar cylindrical container or can that is typically formed out of steel or aluminum.

The rising demand for steel and aluminum containers, though, generates concerns about production costs and the quantity of material used in the fabrication process for these containers. Accordingly, there have been intensified efforts to reduce the wall diameter of steel and aluminum cans in order to reduce the weight and mass of raw material used to create a can of given volume. This saves in the costs of production in two ways. By reducing the quantity of material, lower material costs are obtained. Moreover, the energy required to refine or recycle the material is reduced. A derivative advantage is a reduction in the need for raw materials that must be extracted from the natural resource base.

The reduction in the wall size of containers, however, is not without its problems. While a reduced wall thickness is highly desirable from a material standpoint, structural integrity of the container must be maintained. Since the reduced wall thickness of a container diminishes its inherent strength, improved geometries have been developed to give added strength to the design. An example of such a geometry is the formation of a concave depression in the bottom of a container with this concave depression being commonly referred to as a dome.

Providing the bottom of a container with an inwardly projecting dome has several advantages. First and foremost, such a dome provides structural rigidity to the container, especially where the internal contents of the container are pressurized. This is of particular importance to the beverage industry where carbonated beverages are packaged in the container for storage and sale. Here, the dome structure greatly increases the resistance of the container to expansion or "bloating" so as to maintain integrity of the container while at the same time maintaining the contents of the container in the desired pressurized state. Finally, such a dome provides a surrounding rim that provides a planar contact surface so that the container may rest in a stable manner on a shelf or other storage location.

In the past, container domers have been used to form the dome structure in the bottom of a drawn and iron steel or aluminum containers. The domer is associated with the bodymaker or can forming machine by means of a support framework or mounting bracket. The bottom structure is formed at the end of the draw and iron cycle. Here, a punch or ram carrying the can body through the draw and iron dies includes at its distal end a die structure corresponding to the interior of the desired container bottom. This ram is usually driven by an arm connected to a rotating crank. At the end of the stroke carrying the container body through the press, the container bottom and punch strike against the bottom former, that is, the container domer. The bottom former includes a die structure which is configured to match the shape of the punch thereby to stamp the bottom profile in the container.

Many of the prior art can domers operate strictly on a mechanical basis. After a period of operation, reformed cans fail to meet acceptable dimensional tolerances. This tolerance failure is a result of continual wear and tear on the interacting mechanical components. Thus, these container domers require maintenance and replacement parts so that the reforming operation can be performed under acceptable tolerances. The bottom or can domers which have heretofore been used include a pressure ring and domer die which are connected to an air piston cylinder connected to a pressurized air source. The pressurized chamber of the air cylinder which receives the piston associated with the pressure ring and domer die provides a resilient cushion of compressed air to cushion the impact of the bottom of the container against the domer die. This allows for control of metal flow as the dome is formed.

In an aluminum can, for example, that is used in the beverage industry, it is desired that the dome be approximately 0.400 inch. Due to the compression of the gas in the pressurized cylinder, it is often required that the throw distance of the ram, after contact with the can bottom, be at least 0.700 inch to create a dome of the desired height. This requires engagement of the can bottom and the domer die at a point in the rotation of the rotating crank of the bodymaker that is sufficiently early to create this throw distance. As a result, it is not uncommon for the ram to be traveling at a speed of approximately twenty feet per second when the can bottom panel first strikes the domer die. Thus, the impact energy is relatively high which can cause excessive wear to the container domer assembly.

In my co-pending application, Ser. No. 08/591,307, I disclose a double action mechanical system for reducing the throw distance of the ram, after contact with the can bottom, so as to reduce the impact energy during the doming process. The system disclosed mechanically linked a pair of coacting pistons, preferably by rack and pinion gears so that movement of one piston causes countermovement of the other piston. A pressure ring is disposed on one piston, and a doming die is disposed on the other piston so that only about one-half the throw distance is needed to form the can bottom dome. This assembly is preferably mounted in a housing supported and located to receive a can driven by the ram during the draw and iron cycle of can formation.

Even though my earlier application discloses a coacting double piston system that reduces the impact energy of the ram by having the can strike the pressure ring and doming die nearer to the bottom of the forming cycle, there remains a need for additional apparatus that can achieve the same result. There is a need for such other apparatus to give flexibility to the designer of mechanical systems so that the doming machinery can be tailored to specific manufacturing needs or desires. The present invention is directed to such a system.

SUMMARY OF THE INVENTION

It is an object of the present invention to provide a new and useful container domer that is used to form the bottom profile of a container thereby to increase the mechanical strength of a container when it is filled and pressurized.

Another object of the present invention is to provide a double action domer usable with a cam driven bodymaker which domer is able to form a dome structure in a container at a later point in the cam cycle of the bodymaker thereby to reduce the impact energy affecting the domer.

Yet another object of the present invention is to provide a container domer that utilizes a dual or double action of hydraulically driven countermoving dies to produce a desired bottom profile in the bottom panel of a container.

A further object of the present invention is to provide a can domer of simplified mechanical structure that is inexpensive to produce and easy to maintain.

Still a further object of the present invention is to provide a can domer that will retrofit onto existing bodymaker/can forming machines.

Yet another object of the present invention is to provide a can domer that eliminates the air piston cylinder and the pressurized air source traditionally used on can domer apparatus.

To accomplish these objects, then, the forming apparatus according to the present invention is a container domer operative to form a dome structure in the bottom panel of the container wherein the container has a bottom peripheral edge surrounding the bottom panel. The forming apparatus of the present invention is mountable on a support frame and is operative to form a dome structure in a bottom panel of a container. The container has a bottom peripheral edge surrounding the bottom panel. In its broadest form, the forming apparatus of the present invention includes a first piston, a pressure ring, a second piston and a doming die. The first piston is reciprocally movable in opposite first and second directions relative to the support frame. The pressure ring is disposed on the first piston and is operative to engage the bottom peripheral edge of the container. The pressure ring is configured to reform the bottom peripheral edge of the container to produce a desired shoulder profile as the container is forcibly advanced in the first direction.

The second piston is reciprocally movable in the first and second directions relative to the first piston. The first and second pistons are hydraulically coupled with one another by a hydraulic fluid such that movement of one of the first and second pistons respectively in the first and second directions causes countermovement of another of the first and second pistons in an opposite direction. The doming die is disposed on the second piston and is operative to engage the bottom panel of the container. The doming die is configured to deform the bottom panel into a desired dome structure as the container is forcibly advanced in the first direction relative to the second piston.

The forming apparatus of the present invention also includes a primary reservoir containing hydraulic fluid which contacts the first and second pistons. The first and second pistons have respective fluid contacting surfaces that contact the hydraulic fluid in the primary reservoir to form a reservoir wall for the primary reservoir. The reservoir wall changes in shape as the first and second pistons move relative to each other.

Further, the forming apparatus of the present invention includes an overflow reservoir which also contains the hydraulic fluid. The overflow reservoir is in selective hydraulic fluid communication with the primary reservoir.

In association with the primary reservoir and the overflow reservoir is a valve arrangement that preferably includes an outlet valve and an inlet valve. Each valve is operative in a closed condition to prevent fluid communication between the primary and overflow reservoirs and in an opened condition to permit fluid communication between the primary and overflow reservoirs. The outlet valve opens when a threshold amount of positive fluid pressure is exceeded in the primary reservoir while forming the dome structure in the container. When the outlet valve is opened, hydraulic fluid is allowed to flow from the primary reservoir to the overflow reservoir. The inlet valve opens after forming the dome structure in the container to allow hydraulic fluid to flow from the overflow reservoir to the primary reservoir, thus assuring a fluid-filled state in the primary reservoir.

With the first piston configured as a cylindrical shell and the second piston configured as a cylinder disposed internally of the first piston, the first and second pistons are therefore coaxially arranged with respect to one another. Additionally, the first piston is resiliently biased in the second direction while the second piston is resiliently biased in the first direction. As the container advances in the first direction against the pressure ring, the first piston is caused to travel in the first direction. When this occurs, the pressure in the hydraulic fluid in primary reservoir increases thereby causing the second piston to travel in the second direction.

Further, the forming apparatus of the present invention includes an eccentric adjustment assembly and a cushioned element. The eccentric adjustment assembly is operative to orient the first and second direction of travel of the first and second pistons relative to the support frame. The cushion element is operative to resiliently dampen movement of the container in the first direction.

These and other objects of the present invention will become more readily appreciated and understood from a consideration of the following detailed description of the exemplary embodiment when taken together with the accompanying drawings, in which:

BRIEF DESCRIPTION OF THE DRAWINGS

FIG. 2(*b*) is a side view in partial cross-section of the container shown in 2(*a*) after the dome structure is formed therein;

DETAILED DESCRIPTION OF THE EXEMPLARY EMBODIMENT

The present invention is directed to a double action container domer or forming apparatus that is adapted to form a dome structure in a bottom panel of a container in order to increase the mechanical strength of the container, especially when it is filled and pressurized. An important aspect of the present invention is the use of first and second pistons which are reciprocally movable with respect to one another in opposite directions and which are in fluid communication for countermovement during the formation of a dome structure in the bottom panel of a container. The present invention is designed to be mounted to a standard bodymaker or can forming machine so that, as the container exits the bodymaker, it may be formed in the container domer of the present invention thereby to create the desired dome structure.

Figure 1:
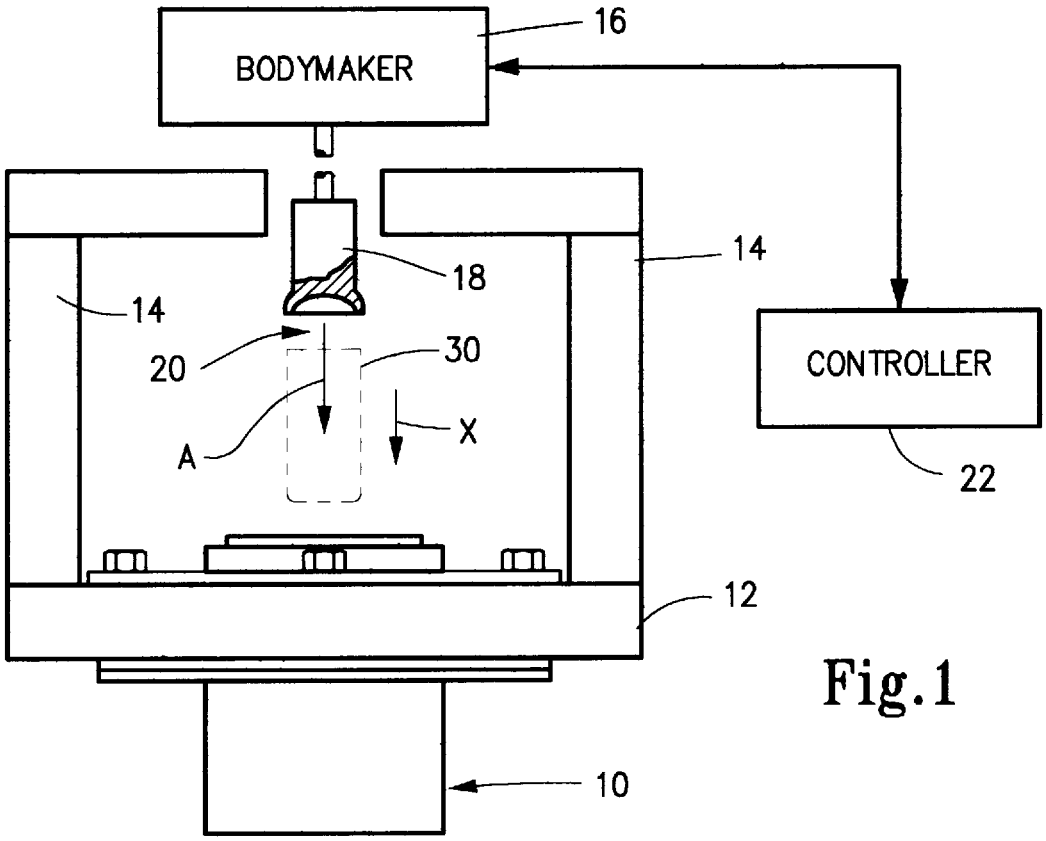
FIG. 1 is a diagrammatic view showing a forming apparatus of the present invention in the environment of a container bodymaker and controller.

Accordingly, as is shown in FIG. 1, the forming apparatus 10 of the present invention is shown mounted to a support frame 12 which, as depicted in this Figure, includes brackets 14 associated with a can forming machine or bodymaker 16. Bodymaker 16 includes both a tool pack and a ram 18 which ram reciprocates to draw and iron an exemplary steel or aluminum container from a sheet of material. Such a container 30 is here shown in phantom. As is shown in this Figure, ram 18 includes a die profile 20 which is the female portion of the die used to create a desired dome structure. This profile 20 may be of any desired selected configuration as is known in the art. Moreover, it should be appreciated that can 30 (in phantom) and ram 18 are shown separated in FIG. 1, for purposes of explanation. However, in operation, ram 18 would be actually be positioned internally of the container 30.

As described more thoroughly below, forming apparatus 10 of the present invention is operated in response to the linear movement of ram 18 in the direction of arrow "A". A controller 22 controls bodymaker 16 as well as receiving positioning information from bodymaker 16 indicating the relative position of ram 18 during the dome structure forming cycle.

Figure 2A:
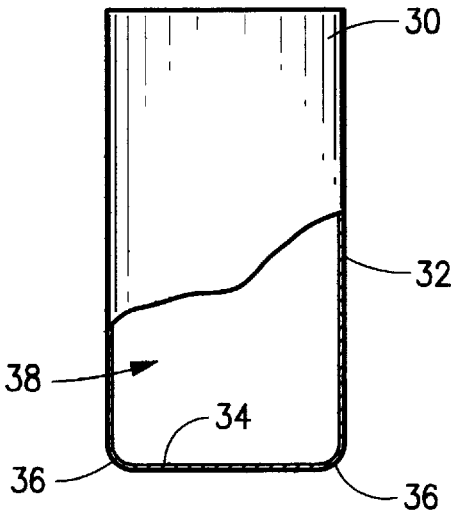
FIG. 2(*a*) is a side view in partial cross-section showing an exemplary embodiment of a container prior to having a dome structure formed therein.
Figure 2B:
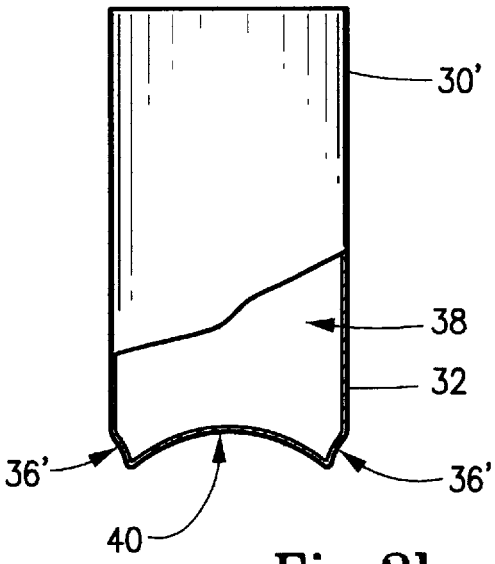

With reference to FIGS. 2(*a*) and 2(*b*), it may be seen that an unformed container 30 is shown in FIG. 2(*a*) in a condition after it has exited bodymaker 16. Here, representative container 30 is in the form of a cylindrical can including a surrounding sidewall 32 and a bottom panel 34 surrounded by a bottom peripheral edge 36 to enclose an interior 38 for container 30. In FIG. 2(*b*), however, it may be seen that container 30' has now had a dome structure 40 formed in bottom panel 34 and peripheral edge 36. More specifically, it may be seen in FIG. 2(*b*) that bottom peripheral edge 36 has been reformed into a desired shoulder profile 36' with dome structure 40 being in the form of a concave depression projecting into the interior 38 of container 30'. For sake of the following explanation of the exemplary embodiment, the container, whether before forming or after forming will be referred simply by the reference numeral "30".

In order to form container with a desired dome structure and shoulder profile, such as dome structure 40 and shoulder profile 36', the forming apparatus 10 of the present invention mates with the ram 18 so that ram 18 operates to forcibly advance container 30 into forming apparatus 10. Forming apparatus 10 is best shown in an in FIGS. 3–6. FIGS. 7(*a*)–7(*d*) respectively show consecutive steps in the formation of the dome structure 40 into bottom panel 34 of container 30.

Turning to FIGS. 3–6, then, it may be seen that forming apparatus 10 is mounted on support frame 12 and includes a piston housing 42 that is preferably in the form of a cylindrical sleeve circular in cross-section that is insertable into a circular opening 44 formed in support frame 12. Piston housing 42 includes an outwardly projecting flange 46 which may be bolted into support frame 12 by means of an annular washer 48 and bolts 50 thereby securing piston housing 42 to support frame 12. Bolts 50 extend through urethane die springs 52 which provide a resilient cushioning affect, as described more thoroughly below. A pair of telescopic annular eccentric elements 54 and 56 extend into opening 44 and are interposed between support frame 12 and a sidewall 58 of piston housing 42. Eccentric elements 54 and 56 may be rotatably positioned to align housing 42 such that its longitudinal axis "L" may be aligned with the throw line of ram 18, with longitudinal axis "L" preferably being perpendicular to support frame 12. Eccentric elements 54 and 56 are held in position on support frame 12 by clamping brackets 55 and bolts 57. A first hydraulic piston 60 is reciprocally movable in opposite first and second directions "x" and "y" respectively (FIG. 4) relative to support frame 12 and is retained in a mounted state in the interior of piston housing 42 by means of a first annular piston retaining ring 62. First annular piston retaining ring 62 is disposed on a top end of piston housing 42, for example, by machines screws 64 and is operative to limit travel of first piston 60 in second direction "y". A second annular piston retaining ring 66 is fastened by means of screws 68 to a first end of first piston 60. As is shown in these Figures, first piston 60 is preferably in the form of a cylindrical shell and is, therefore, circular in cross-section.

Second piston retaining ring 66 acts to retain a second piston 70 in the interior of first piston 60 with second piston 70 being reciprocally movable in the first and second directions "x" and "y" relative to first piston 60. Second piston 70, preferably circular in cross-section, is sized and adapted for close fitted, mated sliding engagement with the inner piston wall 61 of first piston 60 that defines a piston interior while an outer wall 63 of first piston 60 is sized for close-fitted, mated sliding engagement with a surrounding sidewall 43 of piston housing 42 that forms a housing interior that extends longitudinally from the top end to a bottom end of a piston housing 42. A third annular retaining ring 65 is fastened by machine screws 67 on the bottom end of first piston 60 to retain second piston 70 interiorly of first piston 60 and acts to limit travel of second piston 70 in the "x" direction. Third annular retaining ring 65 includes a plurality of retaining ring holes 59 which are disposed equangularly about and radially from longitudinal axis "L". First piston 60 also includes a first plurality of first piston holes 69 which are formed into a bottom portion of first piston 60. The first plurality of first piston holes 69 are disposed equangularly about and radially from longitudinal axis "L" and correspond with the plurality of retaining ring holes 59 so that when third annular retaining ring 65 is fastened to first piston 60, respective ones of first piston holes 69 and retaining ring holes 59 register with one another.

Figure 4:
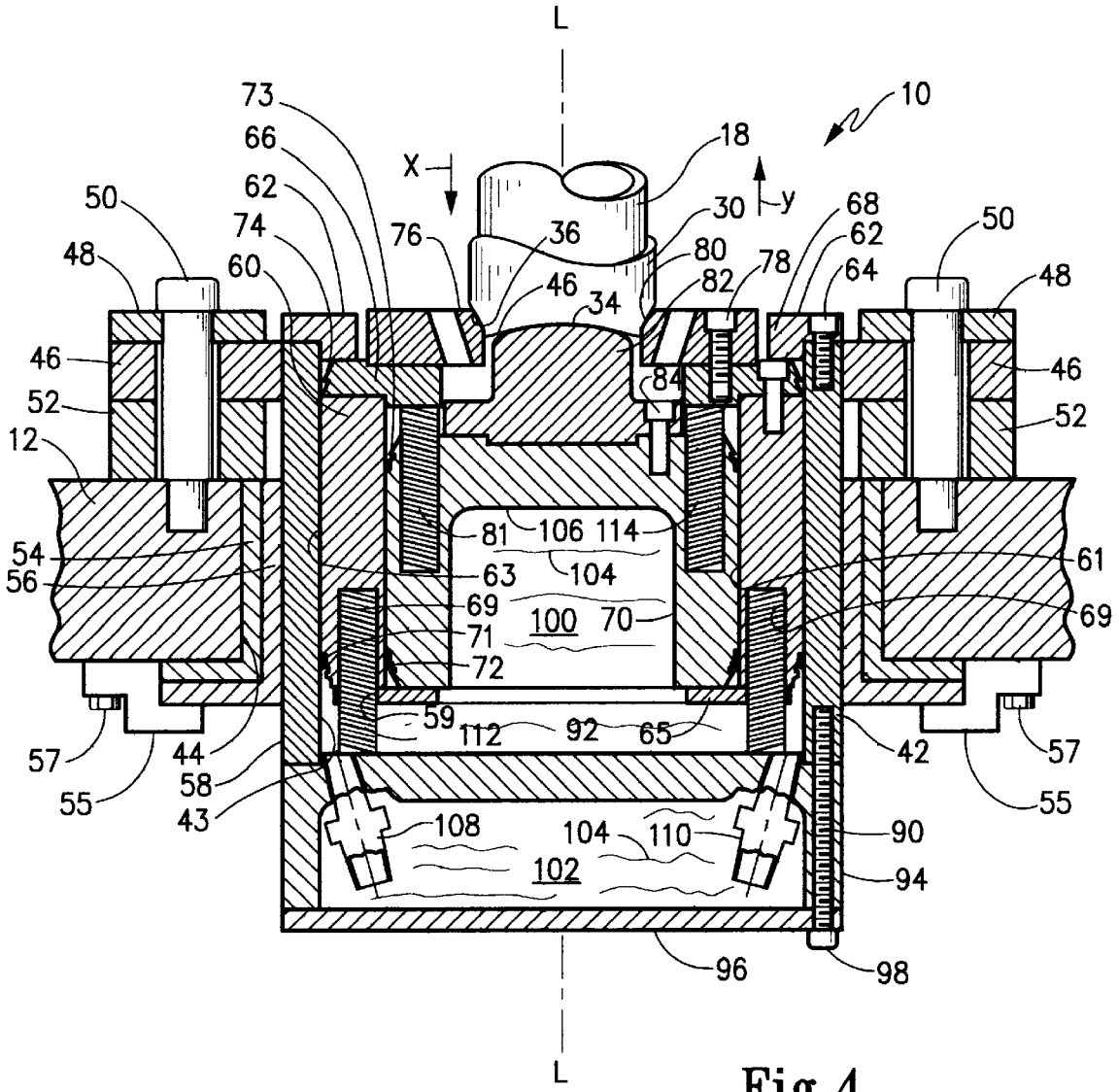
FIG. 4 is a side view in partial cross-section showing the exemplary embodiment of the present invention.

As best shown then in FIG. 4, first piston 60 is disposed in the housing interior of piston housing 42 and is axially aligned with longitudinal axis "L". Thus, first piston 60 is reciprocally movable in first direction "x" toward the bottom end of piston housing 42 and in second direction "y", which is opposite of first direction "x", toward the top end of piston housing 42 with outer piston wall 63 sliding alongside surrounding sidewall 43 of piston housing 42. Second piston 70 is disposed in the piston interior and is axially aligned with longitudinal axis "L". Thus, first and second pistons 60 and 70 respectively are coaxially aligned with respect to one another. Second piston is reciprocally movable in first and second directions "x" and "y" relative to first piston 60 as well as support frame 12. Suitable ring seals, such as conventional O-rings, are utilized with the forming apparatus 10 of the present invention. A first piston seal 71 is operative to maintain sealing contact between first piston 60 and surrounding sidewall 43. A second piston seal 72 and a third piston seal 73 are operative to maintain sealing contact between second piston 70 and inner piston wall 61 of first piston 60. A fourth piston seal 74 is operative to maintain sealing contact between second annular piston retaining ring 66 and surrounding sidewall 43 of piston housing 42. As is commonly known in the art, these piston seals are provided to maintain a relative fluid tight seal as first and second pistons 60 and 70 slide relative to piston housing 42 and with respect to one another.

Figure 3:
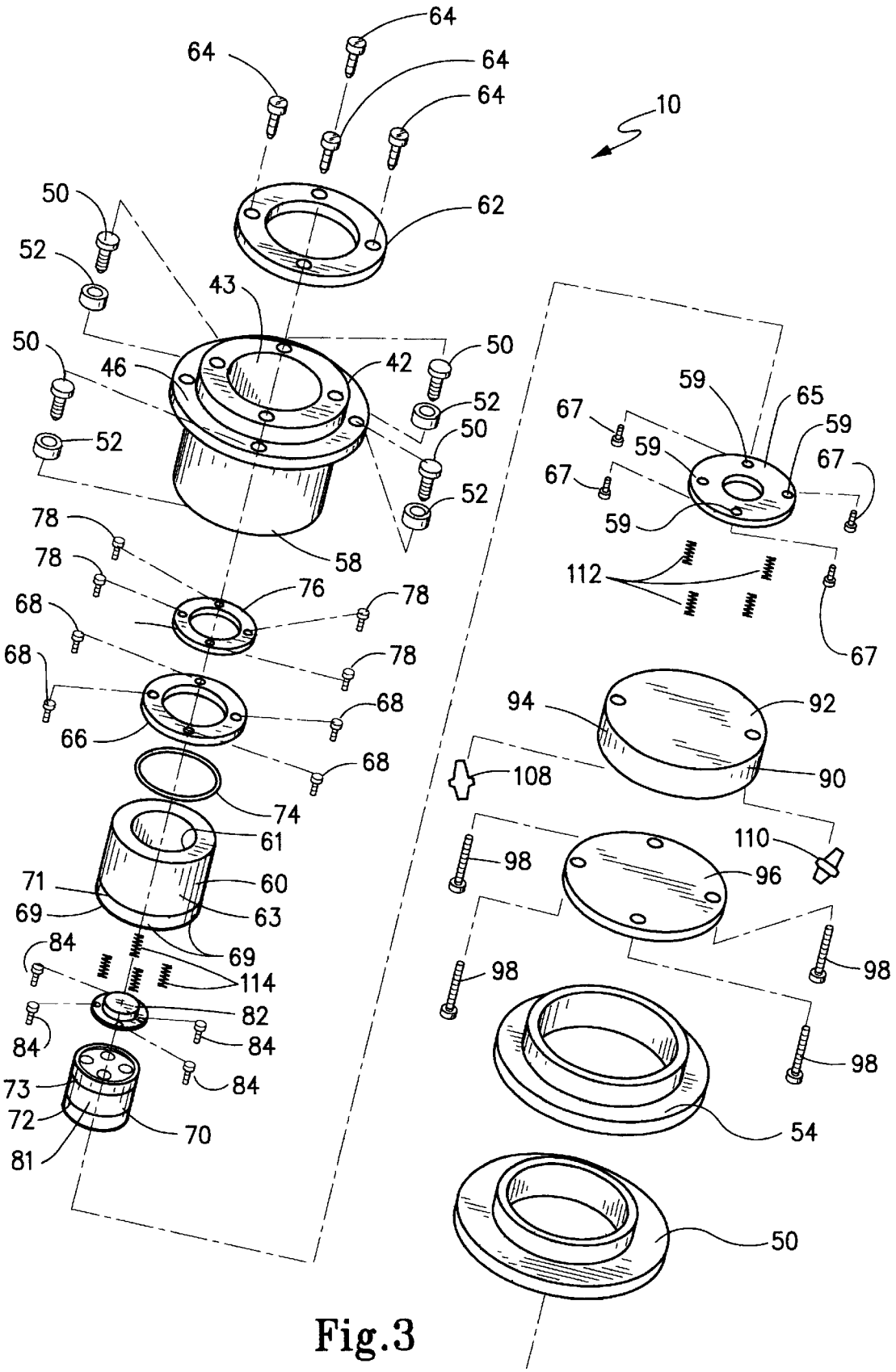
FIG. 3 is an exploded perspective view of the container domer according to the exemplary embodiment of the present invention.
Figure 5:
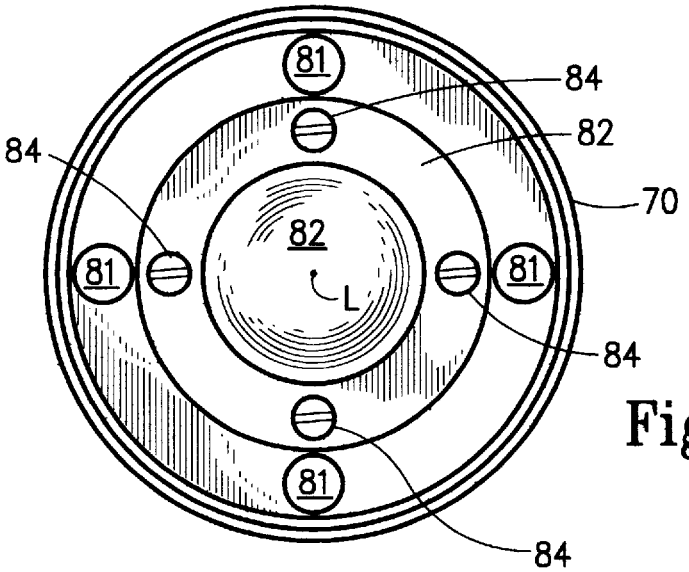
FIG. 5 is a top plan view of a doming die fastened to a second piston by screws and illustrating a plurality of holes formed into a top portion of the second piston and arranged in an equiangular configuration about a longitudinal axis thereof.
Figure 6:
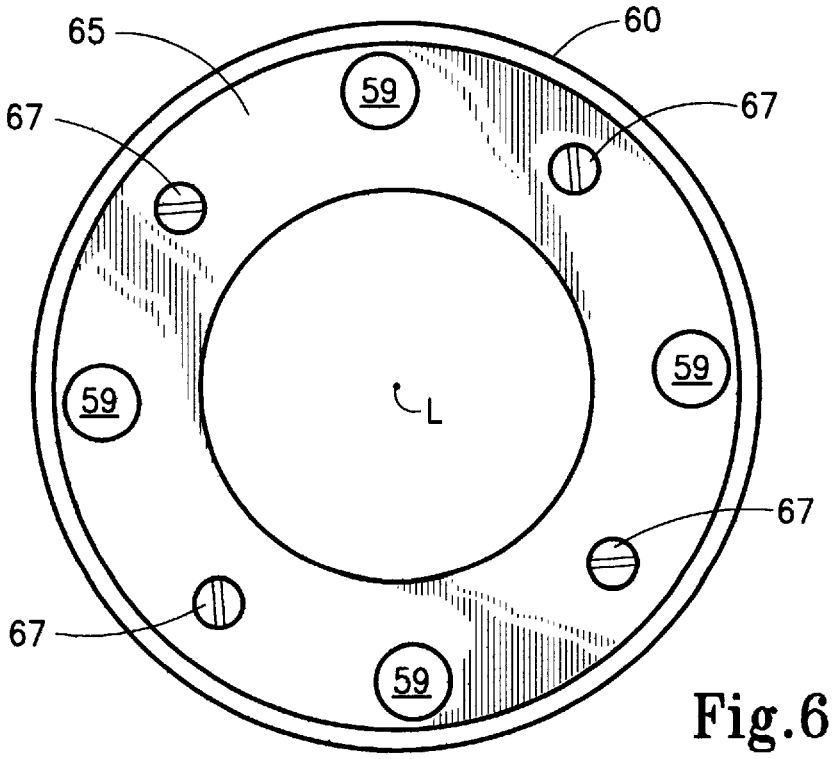
FIG. 6 is a bottom plan view of a first piston with a third annular piston retaining ring fastened thereto by screws and illustrating a plurality of holes formed into a bottom portion of the first piston and arranged in an equiangular configuration about the longitudinal axis.
Figure 7A:
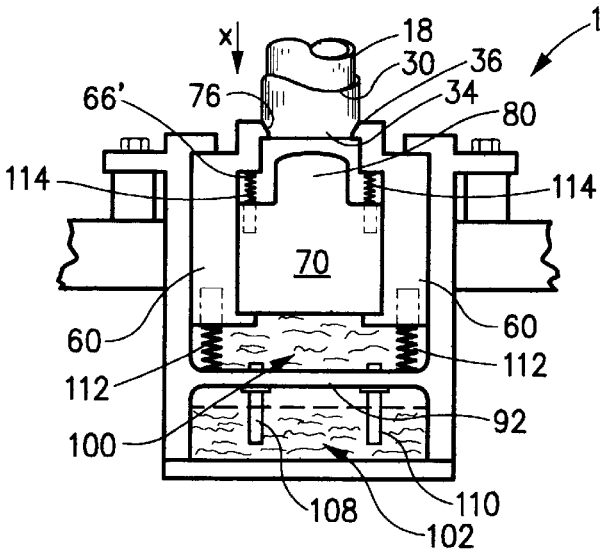
FIG. 7(*a*)–7(*d*) are diagrammatic views with illustrating the forming cycle of the exemplary embodiment of the present invention.
Figure 7B:
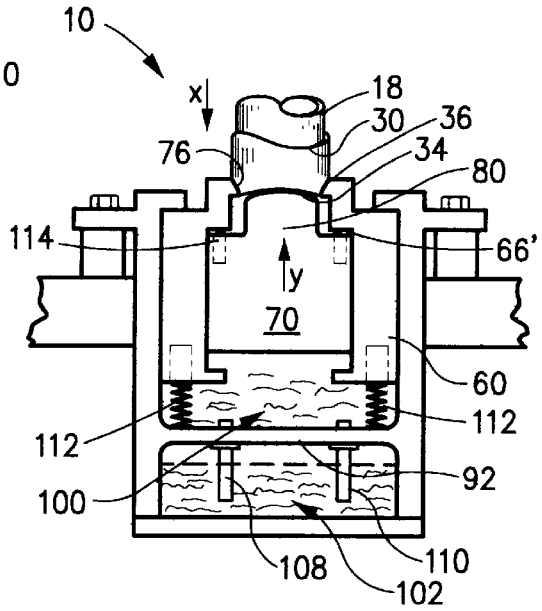
Figure 7C:
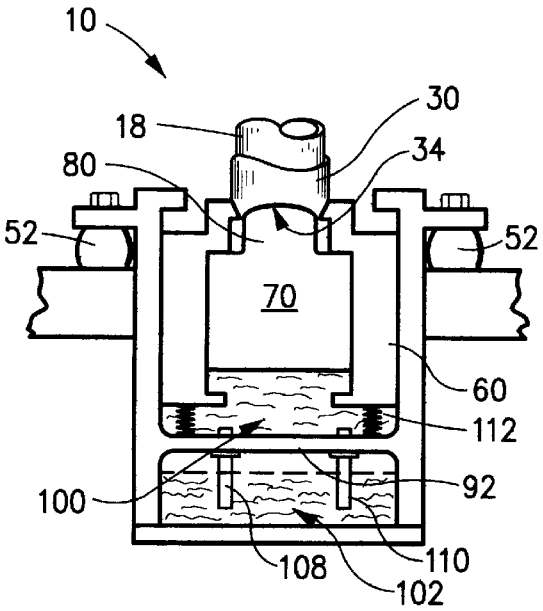
Figure 7D:
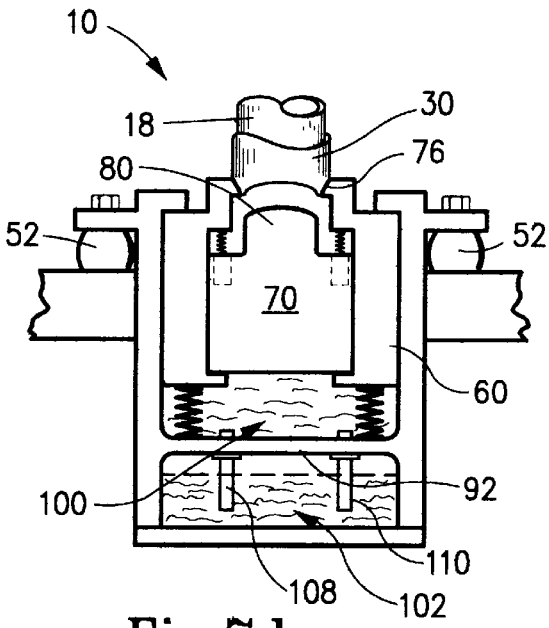

With reference still to FIGS. 3–5, but with particular reference to FIGS. 3 and 4, it may be seen that an annular pressure ring 76 is mounted onto piston retaining ring 66 by means of screws 78. As a result, second annular piston retaining ring 66 is shown to be interconnected between a top portion of first piston 60 and pressure ring 76. In turn, second annular piston retaining ring 66 is operative to limit travel of second piston 70 in second direction "y". Pressure ring 76 has a die profile 80 that is operative to engage the bottom peripheral edge 36 of container 30 and adapted to reform bottom peripheral edge 36 to produce a desired shoulder profile as container 30 is forcibly advanced in the first direction "x" under the movement of ram 18 in the direction of "A" (FIG. 1).

A doming die 82 is mounted at an upper or first end of second piston 70 by means of screws 84. Doming die 82 is configured to have an upper profile 86 configured to form bottom panel 34 into the desired dome structure 40 as the container is forcibly advanced in the first direction. Doming die 82, then, provides male die which mates with the female profile 20 of ram 18, as shown in FIG. 1. As best shown in FIG. 5, a second plurality of second piston holes 81 are formed in a top portion of second piston 70 and are disposed equangularly about and radially from longitudinal axis "L" in a manner to surround doming die 82.

With reference to FIGS. 3 and 4, a reservoir housing 90 is cylindrical in shape and includes a fluid-impervious plate 92 and a downwardly depending reservoir sidewall 94. A base plate 96 connects to a bottom portion of reservoir housing 90 and through reservoir sidewall 94 by means of machine screws 98. As best shown in FIG. 4, machine screws 98 extend through reservoir sidewall 94 and into matable engagement with a bottom portion of piston housing 42. When reservoir housing 90 and base plate 96 are connected to piston housing 42, a primary reservoir 100 which is connected to the bottom end of piston housing 42 and an overflow reservoir 102 are formed. Primary reservoir 100 is filled with a selected hydraulic fluid 104 such as conventional oil and overflow reservoir 102 that is partially filled with the hydraulic fluid 104. Therefore, first piston 60 and second piston 70 contact hydraulic fluid 104 in primary reservoir 100. Specifically, first piston 60 and second piston 70 have respective fluid contacting surfaces that contact hydraulic fluid 104 in primary reservoir 100 to form a primary reservoir wall 106. It is appreciated that first piston 60 and second piston 70 are thus hydraulically coupled to each other.

Overflow reservoir 102 is in selective fluid communication with primary reservoir 100 through a valve assembly. As noted above, overflow reservoir 102 is connected to primary reservoir 100 and separated therefrom by fluid-impervious plate 92. It is preferred that the valve assembly include a one-way outlet valve 108 and a one-way inlet valve 110. Although one of ordinary skill in the art would appreciate that it is possible to incorporate a single valve for selective fluid communication between primary reservoir 100 and overflow reservoir 102. Each valve 108,110 extends into and is connected to fluid-impervious plate 92 in a manner whereby hydraulic fluid 104 can flow through these valves between the primary reservoir 100 and overflow reservoir 102.

Lastly, spring elements are employed with the present invention. Spring elements associated with first piston 60 result in first piston 60 being resiliently biased in second direction "y" and spring elements associated with second piston 70 result in second piston 70 being resiliently biased in first direction "x". Respective ones of a plurality of first piston spring elements 112 are disposed between and in contact with first piston 60 and fluid impervious plate 92. Specifically, each of first piston spring elements 112 is disposed in a respective one of the first plurality of first piston holes 69. Each of second piston spring elements 114 is disposed between and in contact with second piston 70 and second annular piston retaining ring 66. Particularly, each of second piston spring elements 114 is disposed in a respective one of the second plurality of second piston holes 81.

An important feature of the present invention is the dual or double action of this container domer wherein first piston 60 and second piston 70 move in opposite directions with respect to one another during the formation of dome structure 40. This double action substantially reduces the length necessary for the stroke of the ram after the container impacts the pressure ring 62 and the doming die 82; this, in turn, reduces the speed of the ram and thus the impact energy. Furthermore, a skilled artisan would appreciate that both first piston 60 and second piston 70 move relative to support frame 12.

The counteracting movement of first and second pistons 60 and 70 along with pressure ring 76 and doming die 82 may be more fully appreciated, now, especially in reference to FIGS. 7(*a*)–7(*d*). At the start of the dome forming cycle (FIG. 7(*a*)), ram 18 carries container 30 thereon with container 30 being advanced in the first direction "x" until bottom panel 34 comes into contact with pressure ring 76. As ram 18 continues to advance the container into pressure ring 76, peripheral edge 36 begins to reform into the profile of pressure ring 76 (FIG. 7(*b*)). This forcibly movement begins to move first piston 60 in the direction "x" and since pistons 60 and 70 are hydraulically coupled, advancement of first piston 60 in the direction "x" causes second piston 70 to move in direction "y" that is opposite first direction "x" so that doming die 82 increasingly deforms bottom panel 34 from the configuration shown in FIG. 7(*a*) to the formed configuration shown in FIGS. 7(*b*)–7(*c*). During this time, spring elements 112 and 114 compress. Upon completion of deforming bottom panel 34, as shown in FIG. 7(*c*), second spring elements are compressed within second piston holes of second piston and second piston is now stopped from further travel in direction "y" because second piston 70 now abuts second annular piston retaining ring 66.

The moving ram 18 provides significant inertia when performing the deforming operation. In order to compensate for the inertia of ram 18 to minimize its potentially damaging effects to the container as well as the forming apparatus, two types of cushioning is provided. First, cushioning is provided by means of urethane die springs 52 which may slightly flex to absorb the impact of the stamping operation. This is best shown in FIG. 7(*c*). Second, the valve arrangement is employed to dampen such inertia as illustrated in FIG. 7(*d*). The inertia of ram 18 can cause a positive pressure increase in the primary reservoir. Therefore, outlet valve 108 is operative to open when a threshold amount of a positive fluid pressure is exceeded in the primary reservoir while forming the dome structure in the container. This happens when piston 70 contacts shoulder 66' which, in actual construction, is defined by piston retaining ring 66. When continued movement now of both pistons 60 and 70 in the "x" direction, outlet valve 108 opens and hydraulic fluid is allowed to flow from the primary reservoir to the overflow reservoir as shown by the arrows extending from the primary reservoir 100, through opened outlet valve 108 and into overflow reservoir 102 in FIG. 7(*d*) thereby relieving excessive hydraulic fluid pressure above the threshold amount in primary reservoir 100. Therefore, as is seen in this figure, the level of hydraulic fluid in reservoir 102 rises.

Since first and second pistons 60 and 70 are spring biased, they tend to move to their pre-forming condition as shown in FIG. 7(*d*). This tendency provides two advantages. First, if excessive hydraulic fluid pressure was relieved during the deforming operation, that amount of fluid that flowed from the primary reservoir to the overflow reservoir must be returned to the primary reservoir. Thus, inlet valve 110 is operative to open after forming the dome structure in the container to allow hydraulic fluid to flow from the overflow reservoir to the primary reservoir. The opening of inlet valve 110 after forming of the dome structure assures that the primary reservoir is in a fluid-filled state for the subsequent deforming operation. Second, this tendency for the spring-biased first and second pistons also tends to cause die profile 80 to retract from the dome structure itself as shown in FIG. 7(*d*). This also occurs, of course, when ram 18 retracts in the direction "y".

It should be understood that the combination of wall 92 and pistons 60 and 70 create a chamber that varies in configuration during relative countermovement of pistons 60 and 70; thus, they are hydraulically coupled to maintain a constant volume for this chamber. However, when piston 70 reaches the limit stop defined by piston ring 66, movement of piston 60 in the "x" direction now forces piston 70 to move also in the "x" direction. At this point in the cycle, further movement of the pistons 60, 70 in the "x" direction reduces the volume in the cylinder, and hydraulic fluid must be allowed to escape into the overflow reservoir 102. It should thus be appreciated that the threshold setting of outlet valve 108 controls the forming force for the countermovement of pistons 60 and 70. Preferably, this threshold is selected to be 40 psi where aluminum is the material to be formed. Of course a greater or lesser threshold should be selected where the material to be formed has greater or lesser formability.

From the foregoing description, it should be appreciated that the double action of pistons 60 and 70 reduce by approximately fifty percent the stroke length of ram 18 that is necessary to form dome structure 40. For example, then, where dome structure 40 is approximately 0.400 inch in height, a stroke distance of about 0.230 to 0.250 is necessary since this stroke distance is doubled by the double acting pistons. By reducing this stroke distance, the speed of ram 18 that carries the unformed container 30 as it impacts the pressure ring 62 and doming die 82 is greatly reduced as contact now occurs closer to the bottom of the cam drive for the bodymaker. This velocity is now reduced to approximately 2–4 feet per second instead of the velocity of approximately 20 feet per second noted in the background of this invention. Thus, the impact energy would be less than five percent for this velocity difference.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiments of the present invention without departing from the inventive concepts contained herein.

I claim:

1. A forming apparatus mountable on a support frame and operative to form a dome structure in a bottom panel of a container wherein said container has a bottom peripheral edge surrounding said bottom panel, comprising:

(a) a first piston reciprocally movable in opposite first and second directions relative to said support frame;

(b) a pressure ring disposed on said first piston and operative to engage the bottom peripheral edge of said container and configured to reform said bottom peripheral edge to produce a desired shoulder profile as the container is forcibly advanced in the first direction;

(c) a second piston reciprocally movable in the first and second directions relative to said first piston, said first and second pistons being hydraulically coupled with one another by a hydraulic fluid such that movement of one of said first and second pistons respectively in the first and second directions causes counter movement of another of said first and second pistons in an opposite direction; and (d) a doming die disposed on said second piston and operative to engage the bottom panel of said container and configured to deform said bottom panel into a desired dome structure as said container is forcibly advanced in the first direction relative to the second piston.

2. A forming apparatus according to claim 1 including a primary reservoir having an interior containing hydraulic fluid with said first and second pistons respectively having first and second fluid contacting surfaces that engage the hydraulic fluid such that movement of one of said first and second pistons into the interior of the primary reservoir displaces a volume of hydraulic fluid which thereby moves another of said first and second pistons out of the interior.

3. A forming apparatus according to claim 2 wherein said primary reservoir is completely filled with the hydraulic fluid.

4. A forming apparatus according to claim 2 including an overflow reservoir containing said hydraulic fluid and being in selective hydraulic fluid communication with said primary reservoir.

5. A forming apparatus according to claim 4 including a valve assembly having at least one valve operative in a closed condition to prevent fluid communication between said primary and overflow reservoirs and in a opened condition to permit fluid communication between said primary and overflow reservoirs.

6. A forming apparatus according to claim 5 wherein said valve assembly includes an outlet valve which opens when a threshold amount of a positive fluid pressure is exceeded in the primary reservoir while forming the dome structure in said container thereby allowing hydraulic fluid to flow from said primary reservoir to said overflow reservoir and an inlet valve which opens after forming the dome structure in said container to allow hydraulic fluid to flow from said overflow reservoir to said primary reservoir thereby assuring a fluid-filled state in said primary reservoir.

7. A forming apparatus according to claim 6 including a limit stop which engages to prevent movement of said second piston in the second direction beyond a maximum relative to said first piston such that, upon engagement, further movement of said first piston in the first direction causes movement of said second piston also in the first direction, hydraulic fluid displaced by common movement of said first and second pistons in the first direction escaping the interior of said reservoir through said outlet valve and into said overflow reservoir.

8. A forming apparatus according to claim 1 wherein said first and second pistons are coaxial with respect to one another.

9. A forming apparatus according to claim 7 wherein said first piston is configured as a cylindrical shell and wherein said second piston is configured as a cylinder disposed internally of said first piston.

10. A forming apparatus according to claim 9 wherein said second piston is resiliently biased in the first direction.

11. A forming apparatus according to claim 10 wherein said first piston is resiliently biased in the second direction.

12. A forming apparatus according to claim 1 including an eccentric adjustment assembly operative to orient the first and second direction of travel of said first and second pistons relative to said support frame.

13. A forming apparatus according to claim 1 wherein advancement of the container in the first direction against said pressure ring causes said first piston to travel in the first direction thereby increasing pressure in said hydraulic fluid in said primary reservoir thereby causing said second piston to travel in the second direction.

14. A forming apparatus according to claim 1 including a cushion element operative to resiliently dampen movement of said container in the first direction.

15. A forming apparatus according to claim 1 including a spring assembly operative to bias said first piston in the second direction and said second piston in the first direction.

16. A forming apparatus operative to form a dome structure in a bottom panel of a container wherein said container has a bottom peripheral edge surrounding said bottom panel and wherein a ram acts to advance the container in a linear first direction, comprising:

(a) a support frame;

(b) a piston housing secured to said support frame and having a housing interior formed by a surrounding sidewall extending longitudinally from a top end to a bottom end, said piston housing having a longitudinal axis;

(c) a primary reservoir containing a selected hydraulic fluid, said primary reservoir connected to said bottom end of said piston housing;

(d) a first piston formed as a shell having an outer piston wall, an inner piston wall and a piston interior, said first piston being disposed in the housing interior and axially aligned with the longitudinal axis, said first piston being reciprocally movable in a first direction toward the bottom end and an opposite second direction toward the top end with said outer piston wall sliding alongside the surrounding sidewall of said piston housing, said first piston engaging said hydraulic fluid;

(e) a pressure ring disposed on said first piston and operative to engage the bottom peripheral edge of said container and configured to reform said bottom peripheral edge to produce a desired shoulder profile as said container is forcibly advanced in the first direction by said ram;

(f) a second piston disposed in the piston interior and axially aligned with the longitudinal axis, said second piston reciprocally movable in the first and second directions relative to said first piston, said second piston engaging said hydraulic fluid such that said first and second pistons are hydraulically coupled whereby movement of one of said first and second pistons respectively in the first and second directions causes counter movement of another of said first and second pistons in an opposite direction; and (g) a doming die disposed on said second piston and operative to engage the bottom panel of said container and configured to deform said bottom panel into a desired dome structure as said container is forcibly advanced in the first direction relative to the second piston.

17. A forming apparatus according to claim 16 including a first piston seal operative to maintain sealing contact between said first piston and the surrounding sidewall of said piston housing and a second piston seal operative to maintain sealing contact between said second piston and the inner piston wall of said first piston.

18. A forming apparatus according to claim 17 including a first annular piston retaining ring disposed on the top end of said piston housing and operative to limit travel of said first piston in the second direction and a second annular piston retaining ring interconnected between a top portion of said first piston and said pressure ring and operative to limit travel of said second piston in the second direction.

19. A forming apparatus according to claim 18 including a third annular piston retaining ring disposed on a bottom end of said first piston and operative to limit travel of said second piston in the first direction.

20. A forming apparatus according to claim 19 wherein said first piston is resiliently biased in the second direction by a plurality of first piston spring elements, each of said first piston spring elements disposed between and in contact with said first piston and a fluid-impervious plate and wherein said second piston is resiliently biased in the first direction by a plurality of second piston spring elements, each of said second piston spring elements disposed between and in contact with said second piston and said second annular piston retaining ring.

21. A forming apparatus according to claim 20 wherein each of said first piston spring elements is disposed in a respective one of a first plurality of holes formed into a bottom portion of said first piston, said first plurality of holes disposed equiangularly about and radially from said longitudinal axis and wherein each of said second piston spring elements is disposed in a respective one of a second plurality of holes formed into a top portion of said second piston, said second plurality of holes disposed equiangularly about and radially from said longitudinal axis.

22. A forming apparatus according to claim 16 wherein said piston housing and said first and second pistons are circular in cross-section.

23. A forming apparatus according to claim 16 including a overflow reservoir containing said hydraulic fluid and being in selective fluid communication with said primary reservoir, said overflow reservoir connected to said primary reservoir and separated therefrom by a fluid-impervious plate.

24. A forming apparatus according to claim 23 an including an outlet valve and an inlet valve with each valve connected to said fluid-impervious plate, said outlet valve operative to open when a threshold amount of a positive fluid pressure is exceeded in the primary reservoir while forming the dome structure in said container thereby allowing hydraulic fluid to flow from said primary reservoir to said overflow reservoir and said inlet valve operative to open after forming the dome structure in said container to allow hydraulic fluid to flow from said overflow reservoir to said primary reservoir thereby assuring a fluid-filled state in said primary reservoir.

25. A forming apparatus according to claim 16 wherein said first piston is configured as a cylindrical shell and wherein said second piston is configured as a cylinder disposed internally of said first piston whereby said first and second pistons are coaxially arranged with respect to one another.

26. A forming apparatus according to claim 16 wherein said first piston and said second piston have respective fluid contacting surfaces that contact said hydraulic fluid in said primary reservoir to form a primary reservoir wall need that changes in shape as said first and second pistons move relative to each other.

* * * * *